US005647105A

United States Patent [19]

Candotti

[11] Patent Number: 5,647,105

[45] Date of Patent: Jul. 15, 1997

[54] MALE COMPONENT OF PRESS-STUD PARTICULARLY FOR ITEMS OF CLOTHING

[76] Inventor: Riccardo Candotti, Via Roma 83, 35100 Padova, Italy

[21] Appl. No.: 619,399

[22] Filed: Mar. 21, 1996

[30] Foreign Application Priority Data

Mar. 24, 1995 [IT] Italy ..... PD95A0062

[51] Int. Cl.[6] ..... A44B 17/00; A44B 1/34

[52] U.S. Cl. ..... 24/691; 24/95

[58] Field of Search ..... 24/95, 621, 679, 24/687, 682.1, 69.1, 703.1, 703.2, 703.3

[56] References Cited

U.S. PATENT DOCUMENTS

| | | | |
|---|---|---|---|
| 1,373,076 | 3/1921 | Jaquiery | 24/691 |
| 1,831,307 | 11/1931 | King . | |
| 1,872,968 | 8/1932 | Kimbell | 24/691 |
| 2,564,858 | 8/1951 | Reiter | 24/621 X |
| 3,333,306 | 8/1967 | Daddona . | |
| 4,197,617 | 4/1980 | Appelt | 24/691 X |
| 4,512,063 | 4/1985 | Fukuroi | 24/95 X |

FOREIGN PATENT DOCUMENTS

| | | | |
|---|---|---|---|
| 370167 | 1/1907 | France . | |
| 995542 | 12/1951 | France | 24/691 |
| 270636 | 10/1987 | United Kingdom . | |
| 2188827 | 10/1987 | United Kingdom . | |

*Primary Examiner*—Peter M. Cuomo
*Assistant Examiner*—Robert J. Sandy
*Attorney, Agent, or Firm*—Guido Modiano; Albert Josif

[57] ABSTRACT

The male component of a press-stud has a dome that extends, so as to form an undercut region, from a first base that is formed by blanking and plastic deformation from a metal plate.

An intermediate tubular element, which is also formed by blanking and plastic deformation from a metal plate, is inserted axially in the dome, affecting part of its internal extension. The intermediate tubular element extends from a second base to be seamed to the first base by folding the perimetric edge of the first base.

A stem protrudes from a third base and has such a cross-section and length as to pass through the intermediate element, perforating the fabric to which the male component of the press-stud is fixed, and to deform against the dome, interposing a wider region between the dome and the end of the intermediate element.

10 Claims, 2 Drawing Sheets

MALE COMPONENT OF PRESS-STUD PARTICULARLY FOR ITEMS OF CLOTHING

BACKGROUND OF THE INVENTION

The present invention relates to a male component of a press-stud, particularly but not exclusively useful for items of clothing.

Press-studs are widely used and highly appreciated, especially in the field of young people's clothing and in the field of sportswear.

These press-studs, which are usually metallic, are constituted by two components: a male component and a female component.

The press-stud, when closed, has its male component inserted in the female component with slight interference fit.

In some types, the interference between the male component and the female component is ensured by a flexible metal wire that is placed in a seat that is formed perimetrically with respect to the opening of the female component.

In particular, the male component, in conventional press-studs, is substantially constituted by two parts: a dome, which extends so as to form an undercut region from a base that is formed by blanking and plastic deformation from a metal plate, and a tubular pin that also extends from a base and has such a cross-section and length that it can fit inside said dome, deforming plastically, at the top, inside it, thus providing mutual connection.

The pin usually has a constant cross-section, except for the portion related to its free end, which is slightly flared and has sharp edges, since it must cut the fabric that is appropriately interposed between it and the dome and it must fit in the undercut region of said dome.

The male components of known press-studs, structured as described above are not free from drawbacks.

Indeed, the flared configuration of the pin, while facilitating on one hand the cutting of the fabric, on the other hand tends to deform the neck of the dome, which in addition to forming the undercut required for the connection of said pin, is also the region which, when assembled to the female component, makes contact with said female component and anchors in it.

Therefore, a deformation of the neck of the dome often causes poor operation of the press-stud and difficulty in opening or closing it.

Furthermore, the particular coupling between the dome and the pin forces said pin to have very specific dimensions, so that an adequate pin must be associated with each dome, with consequent rigidity in production and poor interchangeability of the elements and components that constitute the press-stud.

SUMMARY OF THE INVENTION

The aim of the present invention is to provide a male component of a press-stud that solves the above mentioned drawbacks of conventional press-studs, particularly eliminating substantially completely the deformations of the dome caused by the insertio of the pin or stem or of other elements inserted therein.

In relation to this aim, an object of the present invention is to provide a male component of a press stud that is constructively simple and easy to assemble and whose production costs are competitive with respect to conventional press-studs.

Another object of the present invention is to provide a male component that allows considerable production flexibility and interchangeability of its parts.

Another object of the present invention is to provide a male component that can be produced with known technologies without substantial modifications to any facilities already provided.

Another object is to provide a male component that is particularly light and therefore preferable, owing to this characteristic, for users over those that are currently commercially available, in particular metal types obtained by casting.

Another object of the present invention is to provide a male component that causes the smallest possible damage to the fabric without in any case producing therein ruptures that are the source of tears in said fabric in the course of time.

With this aim and these and other objects in view, there is provided a male component of a press-stud, particularly for items of clothing, characterized in that it comprises the following elements:

a dome that extends, so as to form an undercut region, from a first base that is formed by blanking and plastic deformation from a metal plate;

an intermediate tubular element, which is also formed by blanking and plastic deformation from a metal plate, to be inserted axially in said dome, affecting part of its internal extension, and extends from a second base to be seamed to the first one by folding the perimetric edge of the latter;

a stem that protrudes from a third base and has such a cross-section and length as to be able to pass through said intermediate element, perforating the fabric to which the press-stud is fixed, and to deform against said dome, interposing a wider region between said dome and the end of said intermediate element.

BRIEF DESCRIPTION OF THE DRAWINGS

Further characteristics and advantages of the present invention will become apparent from the description of two embodiments thereof, illustrated only by way of non-limitative example in the accompanying drawings, wherein.

DESCRIPTION OF THE PREFERRED EMBODIMENTS

Figure 1:
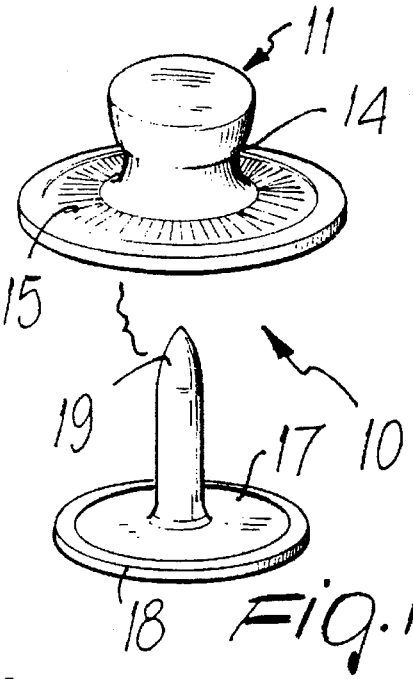
FIG. 1 is a perspective exploded view of a male component of a press-stud according to the invention, in a first embodiment.
Figure 2:
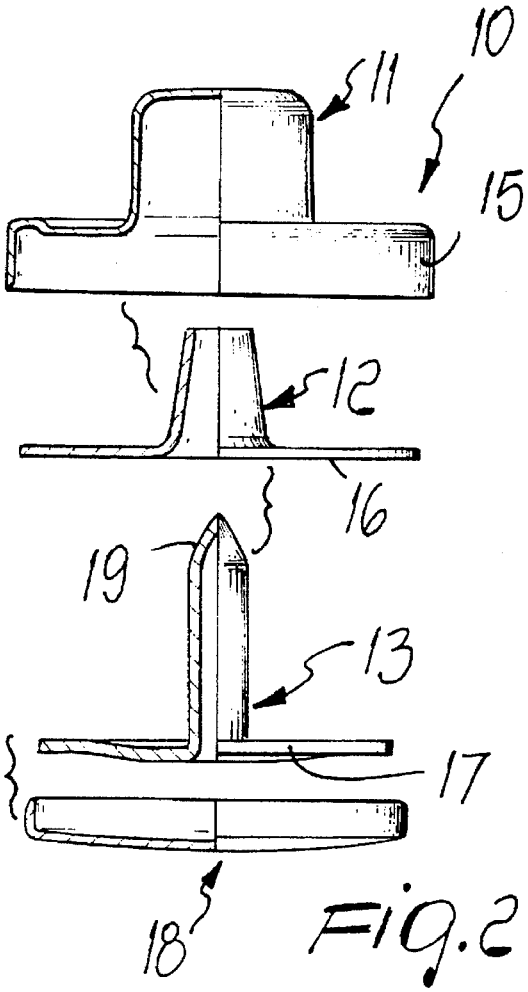
FIG. 2 is a partially sectional exploded view of the male component of FIG. 1 in a preassembly stage.
Figure 3:
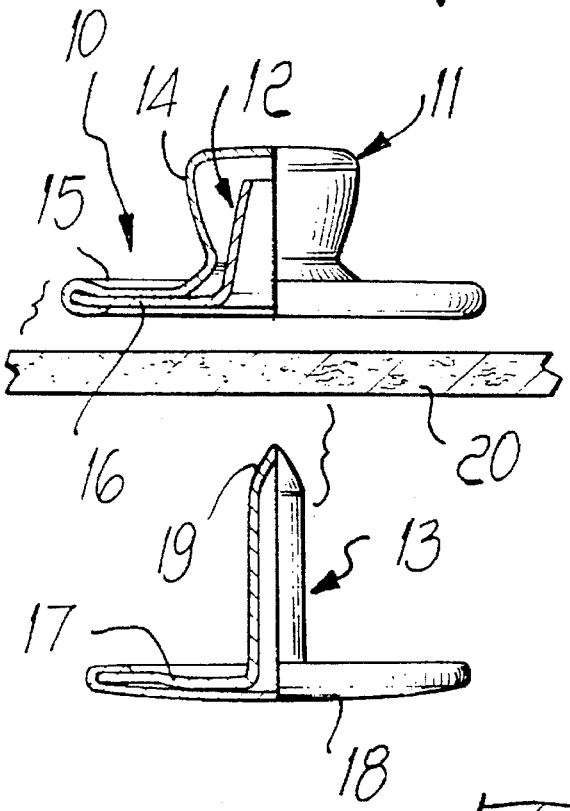
FIGS. 3 and 4 are two partially sectional side views of the male component of FIG. 1 in two different stages of the assembly to the fabric.
Figure 4:
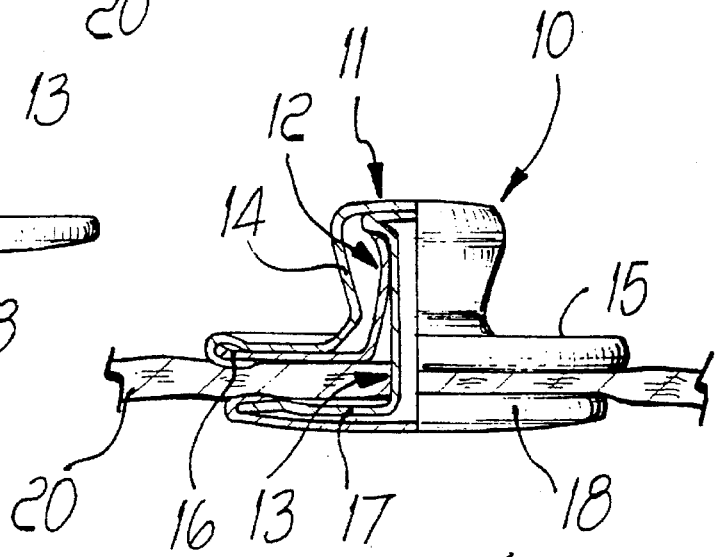

With particular reference to FIGS. 1 to 4, a male component of a press-stud, particularly for items of clothing, according to the invention, is generally designated by the reference numeral 10 in a first embodiment.

The male component 10 comprises the following elements: a dome 11, an intermediate tubular element 12, and a stem 13.

The dome 11 extends, so as to form an undercut region 14, from a first base 15 which in this case is essentially circular and is formed by blanking and plastic deformation from a metal plate.

More specifically, the undercut region 14 is formed by a narrower portion of the dome 11 that externally forms the neck thereof.

The intermediate tubular element 12 is also formed by blanking and plastic deformation from a metal plate and extends from a second substantially circular base 16 to be seamed to the first base 15 by folding the perimetric edge thereof.

The intermediate tubular element 12 is substantially frustum-shaped and tapers toward its free end; upon assembly, it is also inserted axially in the dome 11, affecting part of its internal extension.

The stem 13 extends from a third base 17 that is also substantially circular in this case.

The stem 13, again in this case, is hollow and is formed by blanking and plastic deformation from a metal plate and is therefore hollow; the edge of a metal cover 18 is also seamed at the edge of the third base 17.

The stem 13 has a substantially constant cross-section, except for its free end 19, which is substantially pointed or conical.

The longitudinal extension of the stem 13 causes it to protrude from said intermediate tubular element 12 by passing through it, so that its free end deforms plastically against the inside surface of the dome 11, thus providing the connection therewith, interposing its deformed end indeed between the dome 11 and the intermediate tubular element 12.

The insertion of the stem 13 first in the intermediate tubular element 12 and then in the dome 11 is preceded by the interposition of the flap 20 of fabric on which the male component 10 is to be fixed.

The dome 11 and the intermediate tubular element 12 on one side, and the stem 13 and the metal cover 18 on the other side, are conveniently preassembled before mutually fixing them.

As regards the surfaces of the base 16 and of the base 17 that are directed, upon assembly, toward the flap of fabric 20, they can conveniently undergo a knurling operation in order to increase their friction against said fabric.

In practice it has been observed that the intended aim and objects have been achieved; in particular, the interposition of the intermediate tubular element 12 allows the insertion of the stem 13 or optionally of a pin to cause no deformation of the neck of the dome, thus allowing it to couple perfectly to the female component of the press-stud.

Figure 5:
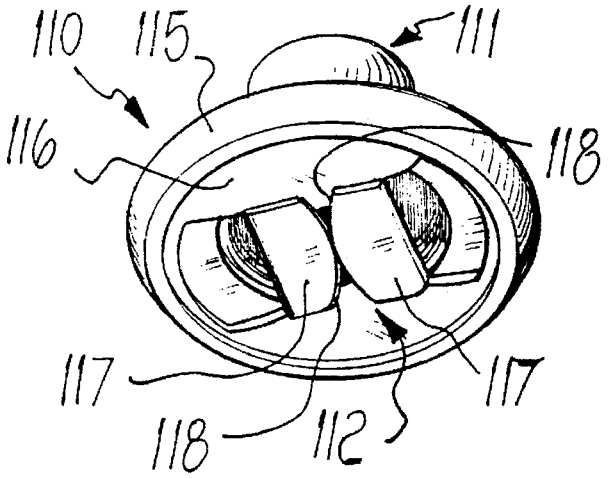
FIG. 5 is a perspective view of a male component of a press-stud according to the invention, in a second embodiment.
Figure 6:
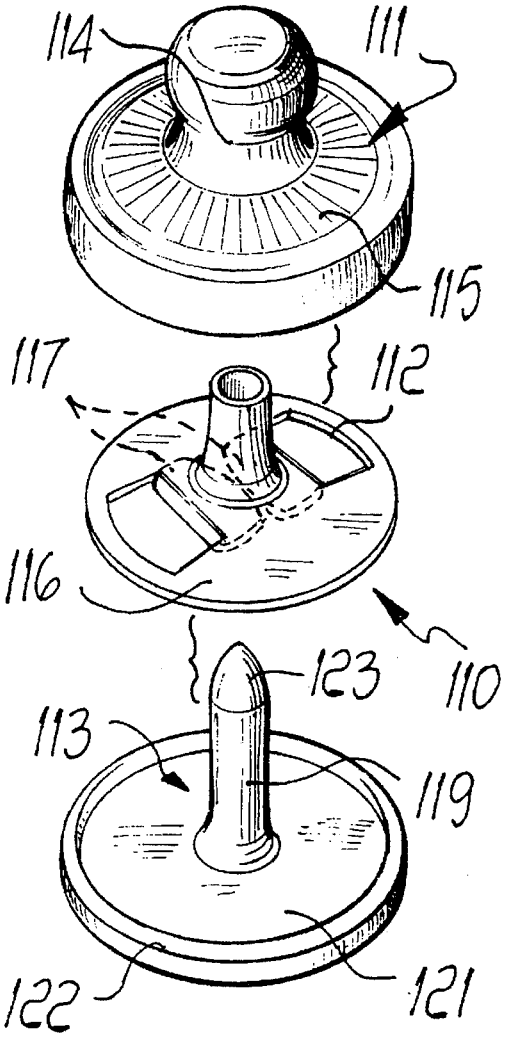
FIG. 6 is an exploded view of the male component of FIG. 5.
Figure 7:
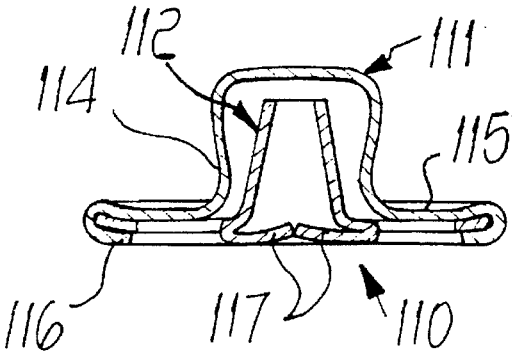
FIG. 7 is a sectional view of part of the male component of FIG. 5.
Figure 8:
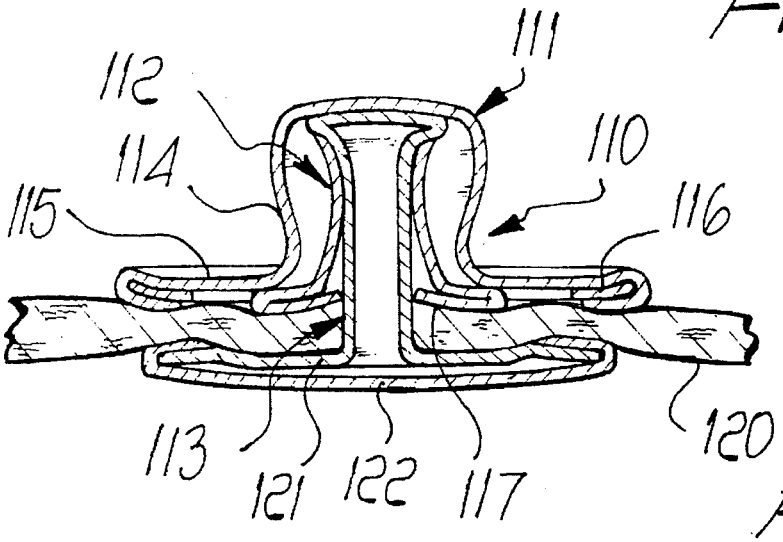
FIG. 8 is another sectional view of the male component of FIG. 5.

With particular reference now to FIGS. 5 to 8, a male component of a press-stud, particularly for items of clothing, according to the invention, is generally designated by the reference numeral 110 in a second embodiment.

The male component comprises the following elements: a dome 111, an intermediate tubular element 112, and a stem 113.

The dome 111 extends, forming an undercut region 114, from a first base 115 which in this case has a substantially circular shape and is formed by blanking and plastic deformation from a metal plate.

The undercut region 114 is formed by a narrower region of the dome 111 that externally forms its neck.

The intermediate tubular element 112 is also formed by blanking and plastic deformation from a metal plate and protrudes from a second substantially circular base 116 to be seamed to the first base 115, folding the perimetric edge of the latter.

The intermediate tubular element 112, in this case, is substantially frustum-shaped and tapers toward its free end; moreover, upon assembly it is inserted axially in the dome 111, affecting part of its internal extension.

Two opposite radial wings 117 are formed in the second base 116 by blanking and folding in opposition to the free end of said intermediate tubular element 112; their free edges 118 face each other and at least partially interfere, during insertion, with the shank 119 of the stem 113 to prevent the curling of the fabric, designated by the reference numeral 120, on which they rest when said fabric is crossed by said stem 113.

In this case, each one of the free edges 118 of the wings 117 is substantially arc-like, so as to make contact with the stem 113 mainly at its median region.

Furthermore, each one of the wings 117 has a substantially rectangular body except for the corresponding free edge 118.

The stem 113 protrudes from a third base 121 that is also substantially circular in this case.

The stem 113, again in this case, is hollow and is formed by blanking and plastic deformation from a metal plate; moreover, it is seamed to the edge of a metal cover 122 at the edge of the third base 121.

The stem 113 has a substantially constant cross-section except for its free end 123, which is substantially pointed or conical.

The longitudinal extension of the stem 113 causes it, by passing through the intermediate tubular element 112, to protrude from said intermediate tubular element, so that its free end deforms plastically against the inside surface of the dome 111, thus providing the connection therewith, interposing its deformed end indeed between the dome 111 and the intermediate tubular element 112.

The insertion of the stem 113 first in the intermediate tubular element 112 and then in the dome 111 is preceded by the interposition of the fabric 120 on which the male component 110 is to be fixed.

Furthermore, the dome 111 and the intermediate tubular element 112 on one side, and the stem 113 and the metal cover 122 on the other, are conveniently preassembled before fixing them to each other.

As regards the surfaces of the second base 116 and the third base 121 that are directed, upon assembly, toward the flap of fabric 120, they can conveniently undergo a knurling operation in order to increase their friction against said flap.

At this point it should be noted that the presence of the wings, which rest on the fabric during the insertion of the stem, avoids substantially completely curling and tearing of said fabric; the male component according to the invention can thus be applied even to particularly light fabrics.

Furthermore, it should be noted that the male component according to the invention, in both embodiments, causes no deformation of the dome during the insertion of the stem, thus allowing it to couple perfectly to the female component of the press-stud as a whole.

It should also be noted that in both cases the intermediate tubular element allows, by virtue of its very shape, to accommodate stems or pins of various sizes, thus allowing a certain interchangeability of the elements that constitute the male component.

The extreme constructive simplicity is to be noted, which allows the male component according to the invention to be highly competitive in terms of production times and costs with respect to conventional press-studs.

Finally, the light weight of the assembly, which is composed of elements obtained by stamping metal plate, should be noted, in particular with respect to conventional male components produced by casting.

The present invention is susceptible of numerous modifications and variations, all of which are within the scope of the inventive concept.

All the details may furthermore be replaced with other technically equivalent elements.

The materials and the dimensions may be any according to the requirements.

What is claimed is:

1. Male component of a press-stud, particularly for items of clothing, comprising:

a dome that extends, so as to form an undercut region, from a first base that is formed by blanking and plastic deformation from a metal plate;

an intermediate tubular element, which is also formed by blanking and plastic deformation from a metal plate, to be inserted axially in said dome, affecting part of an internal extension of said dome, and extends from a second base to be seamed to the first base by folding a perimetric edge of the first base;

a stem that protrudes from a third base and has such a cross-section and length as to be able to pass through the intermediate tubular element, perforating a fabric to which the male component of the press-stud is fixed, and to deform against said dome, interposing a wider region between said dome and a free end of said intermediate tubular element;

wherein at least two opposite radial wings are formed in said second base by blanking and folding in opposition to the free end of said intermediate tubular element, free edges of said wings facing each other and being in at least partial contact, during insertion, with a shank of said stem to prevent the curling of the fabric, on which said wings rest when said fabric is crossed by said stem.

2. Male component according to claim 1, wherein said stem is formed by blanking and plastic deformation from a metal plate.

3. Male component according to claim 1, wherein an edge of a metal cover is seamed to an edge of said third base.

4. Male component according to claim 1, wherein said stem has a constant cross-section except for said free end which is substantially conical.

5. Male component according to claim 1, wherein said stem is hollow.

6. Male component according to claim 1, wherein said intermediate tubular element is substantially frustum-shaped and tapers toward said free end.

7. Male component according to claim 1, wherein said dome and said intermediate tubular element are preassembled prior to coupling to said stem.

8. Male component according to claim 1, wherein each one of the free edges of said at least two wings is shaped like a circular arc and interferes to a greater extent with said stem at a median region of said stem.

9. Male component according to claim 1, wherein said intermediate element is substantially frustum-shaped.

10. Male component according to claim 1, wherein each one of said at least two wings has a substantially rectangular body and a free edge which is shaped like an arc.

* * * * *